United States Patent [19]

Nakamura

[11] 4,027,117

[45] May 31, 1977

[54] HEADPHONE

[76] Inventor: Komatsu Nakamura, 2-10, Nordera 2-chome, Niiza, Saitama, Japan

[22] Filed: Nov. 4, 1975

[21] Appl. No.: 628,843

[30] Foreign Application Priority Data

Nov. 13, 1974 Japan ..... 49-136634[U]

[52] U.S. Cl. ..... 179/180; 179/182 R

[51] Int. Cl.² ..... H04R 1/28

[58] Field of Search ..... 179/180, 182 R

[56] References Cited

UNITED STATES PATENTS 2,249,161 7/1941 Mott ..... 179/180 X 2,540,498 2/1951 Tallman ..... 179/180

3,586,794 6/1971 Michaelis ..... 179/182 R

*Primary Examiner*—William C. Cooper

*Attorney, Agent, or Firm*—Oblon, Fisher, Spivak, McClelland & Maier

[57] ABSTRACT

A headphone supported at the ear position for reproducing sound comprises (a) an oscillating member for sound reproduction, (b) a frame to support the oscillating member, (c) at least one opening constituting a path from the space, defined by the inside of the oscillating member, an ear pad and the ear to the free space on the outside of the oscillating member, and (d) an acoustic resistance member disposed in the opening.

5 Claims, 3 Drawing Figures

HEADPHONE

BACKGROUND OF THE INVENTION

1. Field of the Invention

The present invention relates to a headphone.

2. Description of the Prior Art

In most of the conventional headphones, users have an unnatural closed-in feeling while listening and get tired after long listening times.

As cause for such closed-in feeling, the volume and degree of confinement of the enclosed space defined between the speaker of the headphone and the ear of the user may be raised. Therefore, if the volume of the closed space is expanded, the closed-in feeling is lessened accordingly, but the headphone itself has to be made larger and heavier. If the degree of confinement in the closed space is largely lessened, the closed-in feeling may be lightened, but in such case where the enclosed space is exposed for example by an opening to the atmosphere of the outer free space, low-frequency reproduction is liable to be sacrificed.

BRIEF SUMMARY OF THE INVENTION

Therefore, it is an object of the present invention to provide an improved headphone where the above drawbacks are removed.

In order to achieve this object, the speaker of the headphone according to the present invention is constructed with at least one opening provided in the frame of the cone or diaphragm of the speaker, at the outer periphery thereof, and in front of which an acoustic resistor is inserted so that the cavity defined at the front side of the speaker communicates with the atmosphere of the free space at the rear side of the speaker through the acoustic resistor.

With the above construction, the closed-in feeling is eliminated and the ultra-low frequency (around lowermost audible frequency) reproduction is not sacrificed. Accordingly, the object of the present invention may be achieved.

BRIEF DESCRIPTION OF THE DRAWINGS

Other objects and advantageous features of the invention will be apparent from the description being made with reference to the accompanying drawings, wherein.

DESCRIPTION OF THE PREFERRED EMBODIMENT

Figure 1:
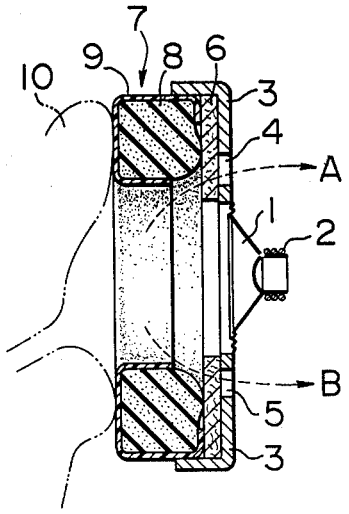
FIG. 1 shows a cross-section of the headphone according to the present invention, shown in the state of being used.

In the center part of a speaker frame 3 is provided an opening to which a cone or diaphragm 1 is fixed. Integrally with the cone or diaphragm 1 is provided coil 2, which is mounted in the magnetic field of a pot core type magnet, not shown, and moves forwardly and rearwardly according to the current flowing through the coil 2. In the frame 3 are further provided openings 4 and 5 in front of which is inserted an acoustic resistor 6, such as textile or felt. An ear pad 7 is made of a porous resilient member 8 of a doughnut shape, such as polyurethane foam, covered by a leather-type material 9 such as vinyl-leather. The leather part 9 does not cover the inner wall of the ear pad 7 on the speaker side and on the frame side, so that the polyurethan foam 8 is exposed directly to the outside at such parts. The numeral 10 shows schematically an ear of the listener.

Figure 2:
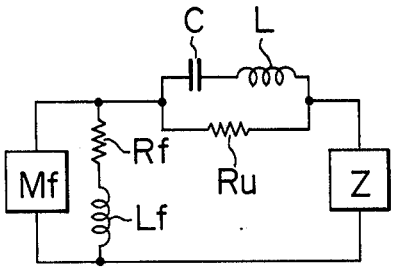
FIG. 2 shows an acoustic equivalent circuit of the speaker while being used.

The above-mentioned construction may be shown with the equivalent circuit of FIG. 2. In FIG. 2, M*f* is the equivalent EMF of the mechanical generator and Z is a radiation impedance. R*f* and L*f* represent the acoustic impedance of the openings 4 and 5 and the felt 6. C represents the acoustic capacitance of the cavity. L represents an inductance corresponding to the mass of the cone or diaphragm and the coil. R*u* represents the acoustic resistance of the polyurethane foam 8.

Figure 3:
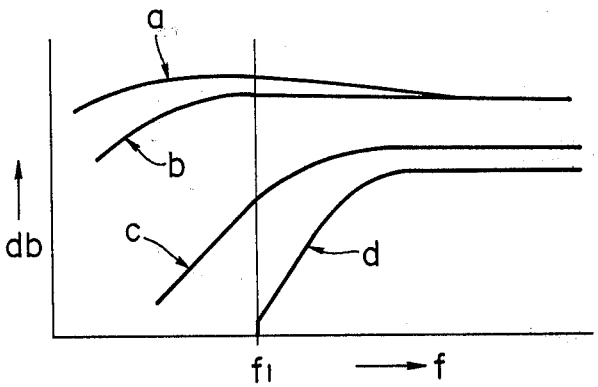
FIG. 3 shows the sound reproducing characteristics of the present invention together with those of other headphones.

It is realized from FIG. 2 that according to the embodiment of the present invention the cavity is not a sealed space but communicates with the atmosphere of the free space through the acoustic impedance R*f*, L*f*, so that the closed-in feeling may be lessened. In FIG. 3, outputs in decibels are shown in relation to the frequency, wherein $f_1$ shows the lowermost audible frequency, i.e. 20–30 Hz. As shown in FIG. 3, when the atmosphere of the free space passes without the acoustic resistor through the openings, the attenuation of the low-frequency reproduction is particularly larger and the reproduction for the middle or high frequency is also not so good as shown in the curves *c* and *d*. The curve *b* shows the reproduction characteristics according to the embodiment of the present invention, from which it will be seen that relatively good reproduction is achieved for the ultra-low frequency sound. The curve *a* shows reproduction characteristics of the completely closed space. As mentioned before, in this case users have an unnatural closed-in feeling while using and get tired after long listening times.

It will be realized from the above description that with the embodiment of the present invention low frequency reproduction is possible with relatively simple means and with less closed-in feeling.

Any further changes or modifications to the embodiment above-explained are possible to the skill of the art within the scope of the present invention. For example, the form of the openings or the acoustic resistors may be selected according to the required purpose, and the openings may not necessarily be formed in the metal frame.

What is claimed as new and desired to be secured by Letters Patent of the United States is:

1. A headphone for reproducing sound at the ear of a listener which comprises:

an oscillating member for sound reproduction;

an ear pad adapted to rest against the ear of the listener;

a frame supporting the oscillating member and the ear pad, the frame being provided with an opening constituting a path from the space defined by one side of the oscillating member, the ear pad and the ear of the listener to the free space on the other side of the oscillating member; and an acoustic resistance member disposed across the opening.

2. A headphone according to claim 1, wherein:

the acoustic resistance member is ring-shaped and is disposed between the frame and the ear pad.

3. A headphone according to claim 1, wherein the ear pad includes:

a porous resilient member; and a leather-like member partly covering the porous resilient member.

4. A headphone for reproducing sound at the ear of a listener which comprises:

an oscillating member for sound reproduction;

an ear pad adapted to extend between one side of the oscillating member and the ear of the listener;

a frame supporting the oscillating member, the frame being provided with a plurality of openings constituting paths from the space defined by the one side of the oscillating member, the ear pad and the ear of the listener to the free space on the other side of the oscillating member; and an acoustic resistance member disposed across the openings.

5. A headphone according to claim 4, wherein:

the acoustic resistance is ring-shaped and covers all of the openings of the frame.

* * * * *